US005784961A

United States Patent [19]

Lorig et al.

[11] Patent Number: 5,784,961

[45] Date of Patent: Jul. 28, 1998

[54] METHOD AND APPARATUS FOR MOUNTING A PRINTING SLEEVE ONTO A PRINTING ROLL

[75] Inventors: Heinz-W. Lorig, Legden; Karl Sauressig, Vreden, both of Germany

[73] Assignee: Polywest Kunstofftechnik, Sauressig & Partner GmbH & Co. KG, Ahaus, Germany

[21] Appl. No.: 788,186

[22] Filed: Jan. 24, 1997

[30] Foreign Application Priority Data

Jan. 31, 1996 [DE] Germany ..... 196 03 500.7

[51] Int. Cl.[6] ..... B41F 27/00; B41F 13/20

[52] U.S. Cl. ..... 101/375; 101/216; 29/895.23; 462/27

[58] Field of Search ..... 101/141, 142, 101/153, 170, 216, 217, 375, 376, 401.1, 483.477, 485, 486, DIG. 36; 492/18, 27, 48, 49, 50, 54, 56; 29/895.21, 895.23, 895.32

[56] References Cited

U.S. PATENT DOCUMENTS

| | | | |
|---|---|---|---|
| 4,119,032 | 10/1978 | Hollis | 101/216 |
| 4,144,812 | 3/1979 | Julian | 101/375 |
| 4,461,663 | 7/1984 | Tachibana et al. | 29/895.21 |
| 4,697,516 | 10/1987 | Rombout | 101/216 |
| 4,807,527 | 2/1989 | Knauer | 101/216 |
| 4,864,926 | 9/1989 | Saueressig | 101/153 |
| 5,678,485 | 10/1997 | Guaraldi | 101/216 |

FOREIGN PATENT DOCUMENTS

| | | | |
|---|---|---|---|
| 000410 | 1/1979 | European Pat. Off. | 101/376 |
| 2031801 | 4/1980 | United Kingdom | 101/376 |

*Primary Examiner*—Stephen R. Funk
*Attorney, Agent, or Firm*—Hill & Simpson

[57] ABSTRACT

A printing sleeve for a rotogravure or flexo printing roll is provided that has a slightly conical or tapered geometry wherein the inner diameter at one end is slightly smaller than the inner diameter at a second end. Similarly, the printing roll is provided with a slightly conical geometry or tapered diameter as well wherein the outside diameter at one end is slightly smaller than the outside diameter at the other end. The larger end of the printing sleeve is mounted over the smaller end of the printing roll and the sleeve is pushed forward either manually or mechanically until the larger end of the printing sleeve is disposed over the larger end of the printing roll. A key/slot combination may be provided on the inside surface of the printing sleeve and outside surface of the printing roll to ensure proper alignment. An apparatus also is provided for mounting a printing sleeve over a printing roll which includes two support bearings for mounting the opposing ends of the printing roll or printing axle. A clamp is provided to positively clamp the larger end of the printing roll against its respective support bearing. A support arm is further provided to balance the printing roll thereby enabling the lowering or release of the support bearing supporting the opposing end of the printing roll. After the sleeve has been partially inserted over the printing roll, the support bearing is then raised and the support arm is released. Then, a push adaptor is provided for forcing the printing sleeve in place over the printing roll with a predetermined amount of force.

10 Claims, 3 Drawing Sheets

METHOD AND APPARATUS FOR MOUNTING A PRINTING SLEEVE ONTO A PRINTING ROLL

BACKGROUND OF THE INVENTION

The present invention relates to rotogravure printing rolls or flexo printing rolls. More specifically, the present invention relates to sleeves for rotogravure printing rolls or flexo printing rolls.

Sleeves for rotogravure printing rolls and flexo printing rolls have been proven successful and may be manufactured in a variety of thicknesses. By providing the sleeves in different thicknesses, different printing lengths may be covered by sleeves of different thicknesses, or different outer diameters, but with the same inner diameter for fitting onto a common core roll size. Therefore, a plurality of printing circumferences can be provided with a minimum number of core rolls.

Further, the sleeves are considerably lighter than printing rolls of a comparable circumference or diameter. Therefore, the sleeves may be transported over long distances with lower freight costs due to their relatively low weight.

Sleeves for rotogravure and flexo printing rolls are known from the EP 0 384 104 B1. It is a disadvantage of the known sleeves that the outer tube has to be provided with an electrically conductive paint coating in order to provide an engravable surface by a galvanic coating.

It is also a disadvantage of these known sleeves that under high loads, the flexo printing axle or rotogravure printing roll and the sleeve may be twisted during the engraving process which interferes with the repetition of the engraving process.

Therefore, it is the object of the invention to provide sleeves with the surfaces thereof that are directly engravable which are simply designed and moreover which are capable of withstanding high pressing forces. Moreover, they must have a long life span and are to be manufactured at low cost.

Further, the mounting and dismounting of the sleeve onto the rotogravure printing roll must be particularly simple.

Therefore, there is a need for an improved rotogravure or flexo printing sleeve that is easily mounted onto and dismounted from a printing roll. Further, there is a need for an improved apparatus for mounting a rotogravure or flexo printing sleeve onto a rotogravure or flexo printing roll. Still further, there is a need for an improved method of mounting rotogravure or flexo printing sleeves onto printing rolls.

SUMMARY OF THE INVENTION

The present invention addresses the above-referenced needs by providing an improved sleeve for a printing roll that comprises a base sleeve with one or more outer layers. The base sleeve has two ends including a first end and a second end as well as an inside surface defining an inside diameter of the base sleeve. The inside diameter of the base sleeve is not uniform; the diameter of the base sleeve decreases along the length of the sleeve. For point of reference purposes, the end of the base sleeve with the larger inside diameter will hereinafter be referred to as the first end and, consequently, the end of the base sleeve with the smaller inside diameter will hereinafter be referred to as the second end.

As a result, a base sleeve having a slightly conical shape or tapered inside diameter is provided, i.e., with a larger inside diameter at the first end and a smaller inside diameter at the second end.

However, even though the inside surface of the base sleeve of the printing sleeve has a tapered or slightly conical geometry, the exterior surface of the printing sleeve must have a cylindrical surface. This can be accomplished in one of two ways. First, the base sleeve itself, even though it has an inside surface with a tapered or slightly conical geometry, can have an outside surface that is cylindrical. Second, given the fact that the printing sleeve typically comprises a base sleeve, an outer rigid tube such as aluminum tube with one or more layers disposed between the base sleeve and the aluminum tube, the aluminum tube can provide a cylindrical geometry and the layers disposed between the aluminum tube and the base sleeve can compensate for any conical or tapered geometry presented by the outer surface of the base sleeve.

Therefore, a printing sleeve made in accordance with the present invention includes a base sleeve having an inside surface with a slightly tapered or conical geometry. The printing sleeve also comprises an outer tube mounted over the base sleeve with one or more layers disposed between the outer tube and the base sleeve. Preferably, those layers include a layer of compressible material mounted to the outer surface of the base sleeve with a layer of foamed spacer material between the outer layer and the tube. Further, an engravable layer is typically applied to the exterior of the tube.

To complement the geometric configurations of the inside surface of the base sleeve, a conical printing axle or printing roll is also provided. The printing roll of the present invention also includes a first end and a second end with an outside surface defining an outside diameter. However, similar to the base sleeve of the printing sleeve of the present invention, the outside diameter of the printing roll of the present invention is not uniform—it is tapered resulting in a conical shape of the printing roll. The end of the printing roll with the larger outside diameter will hereinafter be referred to as the first end and the end of the printing roll with the smaller outside diameter will hereinafter be referred to as the second end.

In operation, the larger first end of the printing sleeve of the present invention is mounted over the smaller second end of the printing roll and slid forward so that the larger first end of the printing sleeve of the present invention is mounted onto the larger first end of the printing roll of the present invention. Despite the fact that both the printing sleeve and the printing roll have slightly conical or tapered configurations, there is still a friction fit between the two components and the printing sleeve must be pushed onto the printing roll with a predetermined amount of force.

In an embodiment, the base sleeve further comprises an inwardly protruding key which is accommodated within a slot disposed on the outside surface of the printing roll.

In an embodiment, the base sleeve is fabricated from glass fiber reinforced plastic material.

In an embodiment, the base sleeve is fabricated from aluminum.

In an embodiment, the inside diameter of the base sleeve at the first end of the base sleeve is about 2 mm larger than the inside diameter of the base sleeve at the second end of the base sleeve.

In an embodiment, the base sleeve further comprises an outer surface and a layer of compressible material is attached to the outer surface of the base sleeve.

In an embodiment, a layer of foam material is attached to the layer of compressible material.

In an embodiment, an aluminum tube is mounted onto the layer of foam material.

In an embodiment, a layer of engravable copper material is attached to the aluminum tube.

In an embodiment, a layer of casting compound is attached to the aluminum tube.

In an embodiment, a layer of a hard foamed compound is attached to the aluminum tube.

Still further, the present invention provides a method of mounting a printing sleeve onto a printing roll comprising the following steps. First, a printing roll is provided as discussed above with a larger first end and a smaller second end. The printing roll further includes an axle or support shaft that extends through the center of the roll. A portion of the shaft or support extends outward past the first and second ends of the roll. The printing roll is clamped or held in place. Then, the first end of a printing sleeve is mounted over the second smaller end of the printing roll and the base sleeve is pushed onto the printing roll so that the larger first end of the base sleeve is pushed toward the larger first end of the printing roll. After the inside surface of the base sleeve has frictionally engaged the outside surface of the printing roll, the base sleeve is continued to be pushed onto the printing roll with a predetermined amount of force.

The present invention also provides an apparatus for mounting a printing sleeve, as described above, onto a printing roll, as described above. The apparatus comprises a first support bearing and a second support bearing for supporting the portion of the axle or shaft that extends outward past the first and second ends of the printing roll. The apparatus further comprises a clamp for clamping the portion of the shaft adjacent to the first end of the printing roll onto the first support bearing. A support arm is also provided for balancing the printing roll and enabling the second support bearing to be lowered below the shaft so that the first end of the printing sleeve can be mounted over the second end of the printing roll. The apparatus also provides a push adaptor which engages the printing sleeve after it has been substantially mounted onto the printing roll and pushes the printing sleeve onto the printing roll with a predetermined amount of force.

A method of operating the above-described apparatus includes the steps of placing the portion of the shaft adjacent to the first end of the printing roll onto the first support bearing, placing the portion of the shaft adjacent to the second end of the printing roll onto the second support bearing, clamping the shaft against the first support bearing with the clamp, engaging the printing roll with the support arm, lowering the second support bearing below the shaft sliding the first end of the printing sleeve toward the first end of the printing roll and the second end of the printing sleeve past the push adaptor, raising the second support bearing so that it engages the portion of the shaft adjacent to the second end of the printing roll, releasing the support arm so that it no longer engages the printing roll, engaging the printing sleeve with the push adaptor, and pushing the first end of the printing sleeve toward the first end of the printing roll with the push adaptor using a predetermined amount of force.

It is therefore an object of the present invention to provide an improved rotogravure printing sleeve.

Another object of the present invention is to provide an improved flexo printing sleeve.

Another object of the present invention is to provide an improved printing roll or printing axle.

Another object of the present invention is to provide an improved method of mounting printing sleeves onto printing rolls.

Still another object of the present invention is to provide an improved apparatus for mounting printing sleeves onto printing rolls.

And another object of the present invention is to provide an improved method of operating an apparatus for mounting printing sleeves onto printing rolls.

Other objects and advantages of the invention will become apparent upon reading the following detailed description and appended claims, and upon reference to the accompanying drawings.

BRIEF DESCRIPTION OF THE DRAWINGS

An embodiment of the invention is further described by referring to the following drawings wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
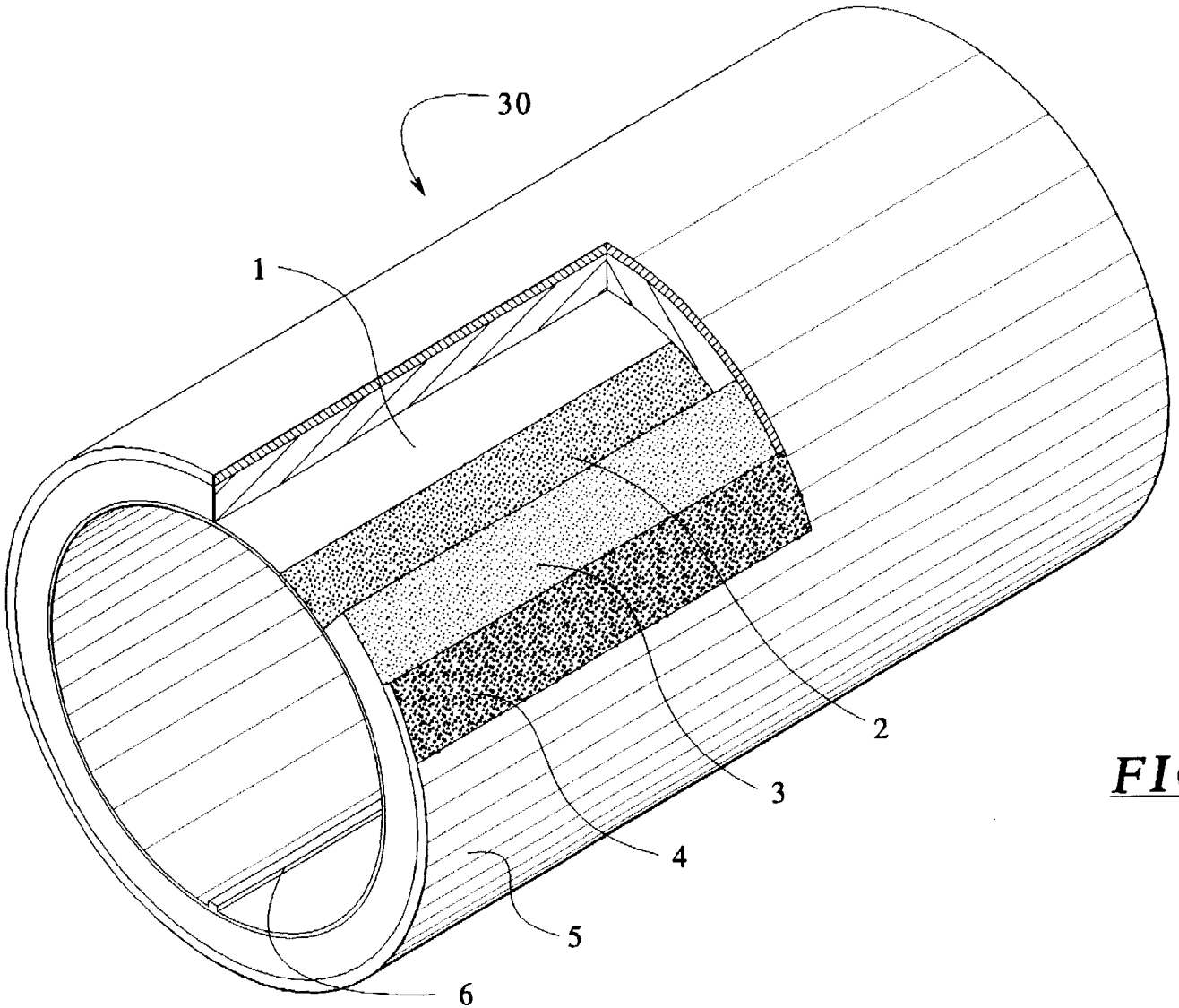
FIG. 1 is an illustration of a part section of a sleeve made in accordance with the present invention.

A sleeve 30 according to the invention for a flexo printing or rotogravure printing roll as illustrated in FIG. 1 consists of a base sleeve 1 of glass fiber reinforced plastic material, a layer 2 fastened thereupon of compressible material, a spacer layer 3 of foamed plastic material fastened thereupon, a cylindrical aluminum tube 4 fastened thereupon, and an engravable copper layer 5 fastened thereupon wherein the sleeve comprises an axially extending key 6 which engages in a groove in the flexo printing or rotogravure printing roll 31 (see FIGS. 2–9).

The positive engagement between the flexo printing or rotogravure printing roll 31 and the sleeve 30 is accomplished by a conicality of the inside surface of the base sleeve 1 and a corresponding conicality of the flexo printing or rotogravure printing roll 31, both of which exhibit about a 2 mm change in diameter across the length of the axle.

The mounting of the sleeve 30 onto the flexo printing or rotogravure printing roll 31 is particularly simple wherein the flexo printing or rotogravure printing roll 31 is clamped only on one side, whereafter the sleeve 30 is pushed on, and the final position is mechanically adjusted with a preset force.

For the manufacture of the sleeve 30, the base sleeve 1 and the layer of compressible material 2 are positioned into the aluminum pipe 4 and the space in between is filled with the spacer foam layer 3.

The pushing on of the sleeve 30 onto the roll 31 may be performed manually.

The device for mounting the sleeve 30 onto the flexo printing or rotogravure printing roll 31 is accomplished in total in eight steps which are illustrated in the FIGS. 2 through 9.

Figure 2:
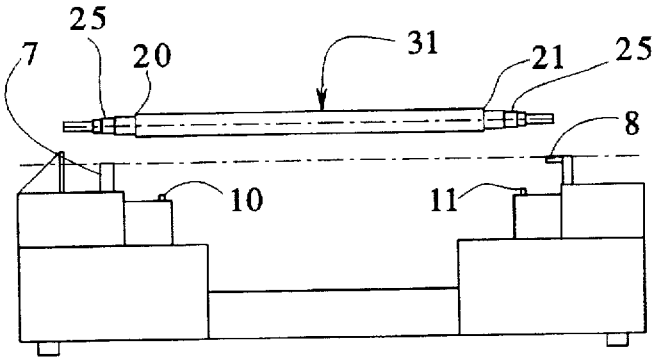
FIG. 2 illustrates a part of the operating process of the device for manufacturing the sleeve in accordance with the present invention.
Figure 3:
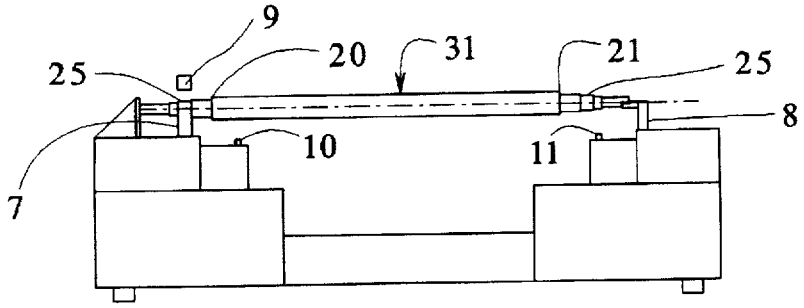
FIG. 3 illustrates a part of the operating process of the device for manufacturing the sleeve in accordance with the present invention.
Figure 4:
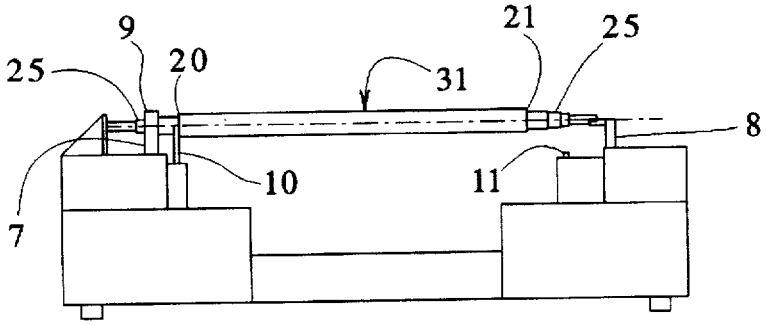
FIG. 4 illustrates a part of the operating process of the device for manufacturing the sleeve in accordance with the present invention.
Figure 5:
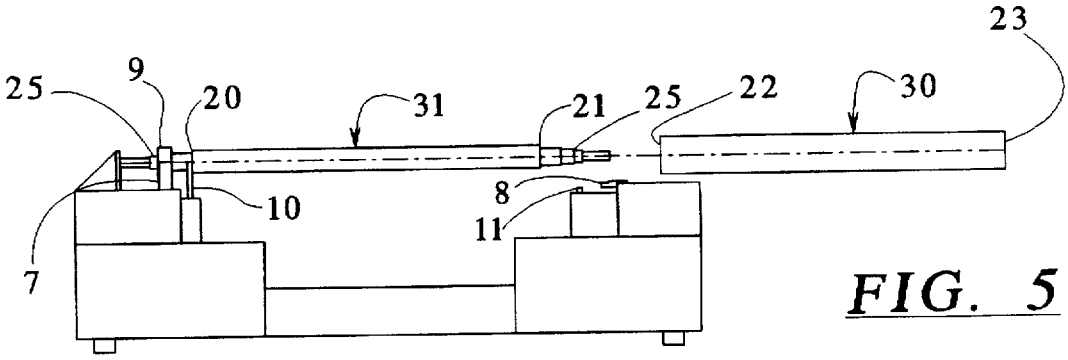
FIG. 5 illustrates a part of the operating process of the device for manufacturing the sleeve in accordance with the present invention.
Figure 6:
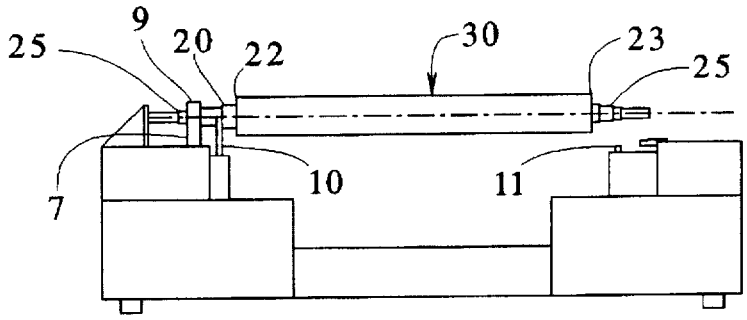
FIG. 6 illustrates a part of the operating process of the device for manufacturing the sleeve in accordance with the present invention.
Figure 7:
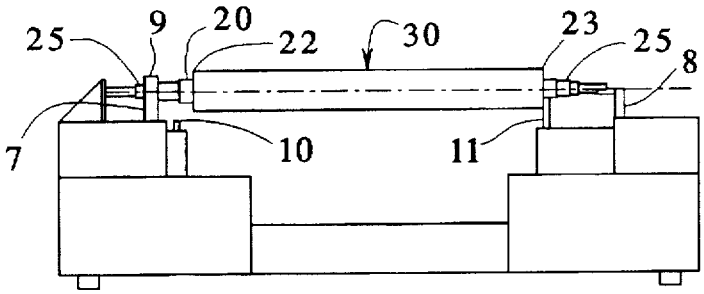
FIG. 7 illustrates a part of the operating process of the device for manufacturing the sleeve in accordance with the present invention.
Figure 8:
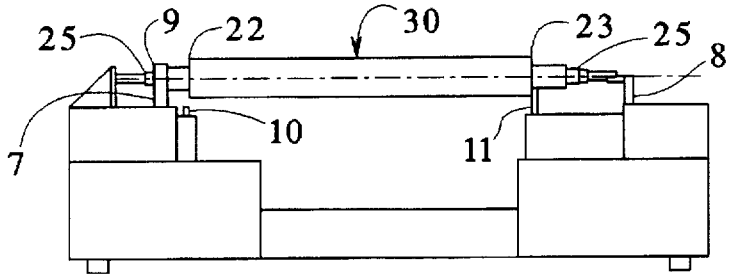
FIG. 8 illustrates a part of the operating process of the device for manufacturing the sleeve in accordance with the present invention.
Figure 9:
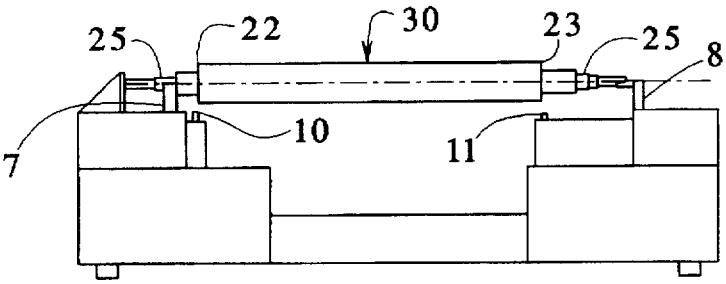
FIG. 9 illustrates a part of the operating process of the device for manufacturing the sleeve in accordance with the present invention.

In FIG. 2, the flexo printing or rotogravure printing roll 31 having first and second ends 20, 21 and a central shaft 25 is placed onto the first and second support bearings 7, 8. In FIG. 3, the flexo printing or rotogravure printing roll 31 at the portion of the shaft 25 disposed adjacent to the left or first end of the roll 31 is securely clamped with a counter bearing 9. In FIG. 4, for balancing the load, a support arm 10 is moved against the roll 31. In FIG. 5, the right or second support bearing 8 is lowered below the shaft 25. Supported by the counter bearing 9 at the left or first end 20 and the support arm 10, the flexo printing or rotogravure printing roll 31 now is free toward the right or second end 21. In FIG. 6, the first end 22 of the sleeve 30 is manually pushed onto the roll 31. In FIG. 7, after the second end 23 of the sleeve 30 moves past the push adapter 11, the second support bearing 8 is moved upward against the shaft 25. The left support arm 10 is moved away. In FIG. 8, the push adaptor 11 pushes the sleeve 30 into the final position with a defined force. In FIG. 9, the flexo printing or rotogravure printing roll 31 with the mounted sleeve 30 is taken away.

The dismounting is accomplished as follows:

The left support arm 10 is used as the push adaptor. It releases the sleeve 30. Therefore, the left support arm 10 has a double function as a support arm and push adaptor.

As illustrated in FIG. 4, the left support arm 10 supports the roll 31. Then, the takeaway of the sleeve 30 from the flexo printing or rotogravure printing roll 31 is accomplished in the same sequence as in the mounting thereof.

In a further embodiment of the sleeve 30 according to the invention as a flexo sleeve, the outer layer 5 may consist of a casting compound or hard foamed compound. In this case, the aluminum tube 4 may consist of plastic material or a plastic material reinforced with glass fiber or carbon fiber, respectively. The construction of the flexo sleeve 30 furthermore corresponds with the current manufacturing technology, i.e. it is a casting or hard foamed compound with a durable surface.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A method of mounting a printing sleeve onto a printing roll comprising the following steps:

clamping the printing roll at a first end thereof, the printing roll comprising the first end, a second end and an outer surface defining an outside diameter of the printing roll, the printing roll having a tapered outside diameter wherein the printing roll is conical in shape with the outside diameter at the first end of the printing roll being larger than the outside diameter at the second end of the printing roll;

supporting the printing roll at a point disposed between the first and second ends thereof with a retractable support arm, pushing a first end of a base sleeve over the second end of the printing roll, the base sleeve comprising the first end, a second end and an inside surface disposed therebetween, the inside surface of the base sleeve defining a tapered inside diameter of the base sleeve wherein the base sleeve is conical in shape with the inside diameter at the first end of the base sleeve being larger than the inside diameter at the second end of the base sleeve, the base sleeve being pushed until the first end thereof approaches the retractable arm and the second end thereof has been pushed past the second end of the printing roll.

supporting the second end of the printing roll, retracting the retractable arm, pushing the base sleeve further onto the printing roll so that the first end of the base sleeve slides past the point where the printing roll was supported by the retractable arm.

2. The method of claim 1 wherein the pushing of the base sleeve over the printing roll is carried out with a predetermined force.

3. The method of claim 1 wherein the pushing of the base sleeve over the printing roll is carried out manually.

4. The method of claim 1 wherein the step of pushing the base sleeve further onto the printing roll further comprises engaging the second end of the base sleeve with a retractable push adapter and pushing the base sleeve further onto the printing roll by pushing the second end of the base sleeve with the push adapter in an axial direction towards the first end of the printing roll.

5. The method of claim 1 wherein the step of supporting the second end of the printing roll further comprises supporting the second end of the printing roll with a retractable support bearing.

6. The method of claim 1 wherein the retractable support arm is movable laterally towards the second end of the printing roll thereby enabling the support arm to engage the first end of the base sleeve and push the base sleeve towards the second end of the printing roll to remove the base sleeve from the printing roll.

7. An apparatus for mounting a printing sleeve onto a printing roll, a printing roll comprising a first end, a second end and an outer surface defining an outside diameter of the printing roll, the printing roll having a tapered outside diameter wherein the printing roll is conical in shape with the outside diameter at the first end of the printing roll being larger than the outside diameter at the second end of the printing roll;

a printing sleeve comprising a base sleeve comprising a first end, a second end and an inside surface disposed therebetween, the inside surface of the base sleeve defining a tapered inside diameter of the base sleeve wherein the base sleeve is conical in shape with the inside diameter at the first end of the base sleeve being larger than the inside diameter at the second end of the base sleeve, the apparatus comprising:

a first support bearing for supporting the first end of the printing roll, a second retractable support bearing for supporting the second end of the printing roll, a clamp for clamping the first end of the printing roll onto the first support bearing, a retractable support arm disposed between the first and second support bearings for balancing the printing roll and permitting removal of the second support bearing to permit the mounting of the first end of the printing sleeve over the second end of the printing roll, a retractable push adaptor disposed between the first and second support bearings to push the first end of the printing sleeve toward the first end of the printing roll with a predetermined force.

8. The apparatus of claim 7 wherein the retractable support arm is movable laterally towards the second end of the printing roll thereby enabling the support arm to engage the first end of the base sleeve and push the base sleeve towards the second end of the printing roll to remove the base sleeve from the printing roll.

9. A method of mounting a printing sleeve onto a printing roll comprising the following steps:

providing the printing roll comprising a first end, a second end and an outer surface defining an outside diameter of the printing roll, the printing roll having a tapered outside diameter wherein the printing roll is conical in shape with the outside diameter at the first end of the printing roll being larger than the outside diameter at the second end of the printing roll;

providing the printing sleeve comprising a base sleeve comprising a first end, a second end and an inside surface disposed therebetween, the inside surface of the base sleeve defining a tapered inside diameter of the base sleeve wherein the base sleeve is conical in shape with the inside diameter at the first end of the base sleeve being larger than the inside diameter at the second end of the base sleeve, providing a first support bearing for supporting the first end of the printing roll, a second support bearing for supporting the second end of the printing roll, a clamp for clamping the first end of the printing roll onto the first support bearing, a retractable support arm disposed between the first and second support bearings for balancing the printing roll, and a retractable push adaptor disposed between the first and second ends of the printing roll to push the first end of the printing sleeve toward the first end of the printing roll, placing the first end of the printing roll onto the first support bearing, placing the second end of the printing roll onto the second support bearing, clamping the first end of the printing roll against the first support bearing with the clamp, engaging the printing roll with the support arm, retracting the second support bearing so that it no longer engages the second end of the printing roll, mounting the first end of the printing sleeve over the second end of the printing roll, sliding the first end of the printing sleeve toward the first end of the printing roll and the second end of the printing sleeve past the push adaptor, returning the second support bearing so that it engages the second end of the printing roll, retracting the support arm so that it no longer engages the printing roll, engaging the second end of the printing sleeve with the push adaptor, pushing the printing sleeve with the push adaptor towards the first end of the printing roll with a predetermined force.

10. The method of claim 6 wherein the steps of mounting the first end of the printing sleeve and sliding the first end of the printing sleeve are performed manually.

* * * * *